US008961291B2

(12) United States Patent
Dias Pires et al.

(10) Patent No.: US 8,961,291 B2
(45) Date of Patent: Feb. 24, 2015

(54) METHOD OF GAMING, A GAMING SYSTEM AND A GAME CONTROLLER

(75) Inventors: Claudio Daniel Dias Pires, Bonnyrigg Heights (AU); Gregory Leigh Plowman, Alexandria (AU)

(73) Assignee: Aristocrat Technologies Australia Pty Ltd (AU)

( * ) Notice: Subject to any disclaimer, the term of this patent is extended or adjusted under 35 U.S.C. 154(b) by 1795 days.

(21) Appl. No.: 11/971,670

(22) Filed: Jan. 9, 2008

(65) Prior Publication Data

US 2008/0167125 A1 Jul. 10, 2008

(30) Foreign Application Priority Data

Jan. 9, 2007 (AU) ..... 2007900073
Dec. 4, 2007 (AU) ..... 2007906617

(51) Int. Cl.
*G07F 17/34* (2006.01)
*G07F 17/32* (2006.01)

(52) U.S. Cl.
CPC ..... *G07F 17/32* (2013.01)
USPC ..... 463/20; 463/16

(58) Field of Classification Search
USPC ..... 463/16, 20, 31
See application file for complete search history.

(56) References Cited

U.S. PATENT DOCUMENTS 6,517,432 B1 * 2/2003 Jaffe ..... 463/16
6,918,832 B2 * 7/2005 Baerlocher et al. ..... 463/20
7,402,102 B2 * 7/2008 Marks et al. ..... 463/20
7,744,457 B2 * 6/2010 Gauselmann ..... 463/20
7,753,769 B2 * 7/2010 Gomez et al. ..... 463/16
2002/0052233 A1 5/2002 Gauselmann
2003/0022712 A1 1/2003 Locke
2003/0060267 A1 3/2003 Glavich et al.
2003/0203753 A1 10/2003 Muir et al.
2004/0048646 A1 * 3/2004 Visocnik ..... 463/16
2008/0108411 A1 * 5/2008 Jensen et al. ..... 463/20
2008/0167115 A1 * 7/2008 Singer et al. ..... 463/20
2008/0188286 A1 * 8/2008 Jaffe ..... 463/20

FOREIGN PATENT DOCUMENTS

AU 200014824 C 8/2000
EP 1197932 A2 4/2002
EP 1197932 A3 4/2002
EP 1422672 A2 5/2004
EP 1422672 A3 5/2004

* cited by examiner

*Primary Examiner* — Jay Trent Liddle
(74) *Attorney, Agent, or Firm* — McAndrews, Held & Malloy, Ltd.

(57) ABSTRACT

A gaming system is disclosed which comprises a display, a symbol selector arranged to select at least a first set of normal symbols to be displayed by the display at a plurality of display positions and to cause a special symbol to be displayed at a display position, a special symbol controller arranged to replicate an aspect of the special symbol until an end condition is met, the special symbol controller arranged to maintain each previously displayed special symbol in the display position where the special symbol occurred, select at least one display position for each replicated aspect of the special symbol and cause each replicated aspect of the special symbol to be displayed at the selected position, and an outcome generator arranged to determine at least one game outcome based on the displayed special symbol, the displayed normal symbols and the replicated aspect of the special symbol. A corresponding method is also disclosed.

37 Claims, 12 Drawing Sheets

1060a 1060b 1060c 1060d 1060e

| | | | | |
|---|---|---|---|---|
| A | K | Q | 10 | A |
| K | Wild | J | 9 | Q |
| 10 | 9 | 10 | J | 9 |

1062

Figure 10A 1060a 1060b 1060c 1060d 1060e

| | | | | |
|---|---|---|---|---|
| A | K | Q | 10 | A |
| K/wild | Wild | J/Wild | 9 | Q |
| 10 | 9/Wild | 10 | J | 9 |

1064 1064 1064

Figure 10B 1100a 1100b 1100c 1100d 1100e

| | | | | |
|---|---|---|---|---|
| A | K | Q | 10 | A |
| K | K | J | Bee | Q |
| 10 | 9 | 10 | J | 9 |

1110

Figure 11A 1100a 1100b 1100c 1100d 1100e

| | | | | |
|---|---|---|---|---|
| A | K | Wild *2 | Wild *2 | Wild *2 |
| K | K | Wild *2 | Bee | Wild *2 |
| 10 | 9 | Wild *2 | Wild *2 | Wild *2 |

Figure 11B 1120 1120 1110 1120

1200a 1200b 1200c 1200d 1200e

| | | | | |
|---|---|---|---|---|
| A | K | Q | 10+ | A |
| K+ Infected x2 | K+ | K+ | K | Q |
| 10 | 9+ | 10 | J+ | 9 |

1210 1220 1220

Figure 12A 1200a 1200b 1200c 1200d 1200e

| | | | | |
|---|---|---|---|---|
| A | K | Q | 10+Infected x2 | A |
| K+ Infected x2 | K+ Infected x2 | K+ Infected x2 | K | Q |
| 10 | 9+ | 10 | J+ Infected x2 | 9 |

1210 1210 1210 1210

Figure 12B 1300a 1300b 1300c 1300d 1300e

| | | | | |
|---|---|---|---|---|
| PIC1 | PIC2 | Q | 10 | A |
| PIC1 | J | PIC1 + Infected | A | PIC1 |
| 10 | PIC1 + In1062 | 10 | 9 | PIC1 |

1310 1312

Figure 13A 1300a 1300b 1300c 1300d 1300e

| | | | | |
|---|---|---|---|---|
| PIC1 | PIC2 | PIC1 | 10 | A |
| PIC1 | PIC1 | PIC1 | PIC1 | PIC1 |
| PIC1 | PIC1 | PIC1 | 9 | PIC1 |

Figure 13B

1412

1400a 1400b 1400c 1400d 1400e

| | | | | |
|---|---|---|---|---|
| K | K + Infected | Q + Infected | 10 + Infected | A |
| Q | Q | Q | A | J |
| WILD | 9 | 10 + Infected | 9 | PIC1 |

1410 1414 1416

Figure 14A 1400a 1400b 1400c 1400d 1400e

| | | | | |
|---|---|---|---|---|
| K | K+ Infected | WILD | 10 + Infected | A |
| SCATTER | Q | SCATTER | A | J |
| WILD | SCATTER | 10 + Infected | 9 | PIC1 |

Figure 14B 1500a 1500b 1500c 1500d 1500e

| | | | | |
|---|---|---|---|---|
| K | K | Q | 10 | A |
| Q+ Infected x2 | Q | Q | A | J |
| WILD | 9 | 10 | 9 | PIC1 |

1510

Figure 15A 1500a 1500b 1500c 1500d 1500e

| | | | | |
|---|---|---|---|---|
| K | K | Q | 10 | A |
| Q+ Infected x2 | Q | Q + Infected x2 | A | J |
| WILD | 9 + Infected x2 | 10 | 9 + Infected x2 | PIC1 |

1510 1512 1514 1516

Figure 15B

METHOD OF GAMING, A GAMING SYSTEM AND A GAME CONTROLLER

CROSS REFERENCE TO RELATED APPLICATIONS

This application claims priority to Australian Patent Application No. AU2007906617, having an international filing date of Dec. 4, 2007, entitled "A Method of Gaming, A Gaming System, and A Game Controller," and Australian Patent Application No. AU2007900073, having an international filing date of Jan. 9, 2007, entitled "A Method of Gaming, A Gaming System, and A Game Controller," each of which is hereby incorporated by reference herein in its entirety.

FIELD OF THE INVENTION

The present invention relates to a method of gaming, a gaming system and a game controller.

BACKGROUND TO THE INVENTION

Australian patent 762889 discloses a game where a special symbol is held in a superimposed representation in a position where it initially occurred for at least one further game while at least the reel carrying the special symbol is re-spun.

In Australian patent 755879 discloses a "roaming wild" symbol which moves in a predetermined pattern relative to the displayed symbols with game outcomes evaluated after each movement. In contrast to the system of AU 762889, none of the reels are re-spun.

There is a need for an alternative game of interest to the player.

SUMMARY OF THE INVENTION

In a first aspect, there is disclosed a method of gaming comprising:

selecting and displaying at least a first set of normal symbols at a plurality of display positions;

displaying a special symbol at a display position;

replicating an aspect of the special symbol until an end condition is met, the replication being performed by maintaining each previously displayed special symbol in the display position where the special symbol occurred, selecting at least one display position for the replicated aspect and displaying each replicated aspect of the special symbol at the selected position; and determining at least one game outcome based on the displayed special symbol, the displayed normal symbols and the replicated aspect of the special symbol.

The aspect of the special symbol to be replicated may be the special symbol or a function associated with the special symbol, for example.

In an embodiment, during replication, at least one display position adjacent the special symbol is selected. In an embodiment, one adjacently disposed display position is selected. In an alternative embodiment, a plurality of adjacently disposed display positions are selected, for example all adjacently disposed display positions are selected.

Replication may comprising repeating the replicating step such that the replicated aspect is progressively displayed at a plurality of display positions, for example such that the replicated aspect progressively moves across a display area.

In one embodiment, replication is performed by replacing a normal symbol with a special symbol or by replacing a normal symbol with a function symbol associated with the replicated function. In addition or alternatively, replication is performed by adding a special symbol to a normal symbol or by adding a function symbol associated with the replicated function to a normal symbol.

In one embodiment, at least one of the normal symbols comprises a visible tag, and only display positions having normal symbols which comprise a tag are susceptible to receiving a replicated symbol or to receiving a replicated function. With this embodiment, the display position having normal symbols comprising a tag may be selected at random for reception of a replicated symbol or reception of a replicated function.

In an alternative embodiment, at least one of the normal symbols comprise a visible tag, and only display positions having normal symbols which do not comprise a tag are susceptible to reception of a replicated symbol or to reception of a replicated function.

The tag may comprise a "+" identifier, for example.

In one embodiment, a function associated with a special symbol affects a game outcome only when the function is replicated at a selected display position.

In one embodiment, a plurality of functions are associated with a special symbol, and a function to be replicated is randomly selected from the associated functions.

In one embodiment, a plurality of functions are associated with a special symbol, and all functions are replicated to a selected display position.

It will be understood that with embodiments wherein an aspect of a special symbol is replicated to an adjacent display position and subsequently replicated from the adjacent display position to a further adjacent display position, the replications are akin to an infection which gradually spreads, such as from left to right across a display area, from an initial "infectious" special symbol to adjacently disposed normal symbols which then become "infected" with the special symbol or a function associated with the special symbol.

In some embodiments, the display positions define a rectangular display area and the left side is treated as contiguous with the right side and the bottom is treated as contiguous with the top such that each adjacently selected display position corresponds to a display position within the display area.

In an embodiment, the end condition is that a predetermined maximum number of replications have been made.

In an embodiment, the display positions define a display area and the end condition is that a selected adjacent display position would cause a replicated symbol to be outside the display area.

In an embodiment, the special symbol is displayed if selected.

In an embodiment, the special symbol is displayed in response to a start condition being met.

In an embodiment, the start condition is that the first set of normal symbols contains a predetermined symbol combination.

In an embodiment, a game outcome is determined based on the displayed symbols after each special symbol is displayed and prior to any further replication of the special symbol.

In an embodiment, a further set of normal symbols is selected prior to each replication of the special symbol and a game outcome is determined based on the further set of normal symbols and the special symbols.

In another embodiment, the game outcome is determined after all the special symbols are displayed. Thus, the game outcome is not evaluated until the end condition is met.

Depending on the embodiment, the display position of the first special symbol may be predetermined, randomly selected from the display positions, or randomly selected from a subset of the display positions (for example, in embodiments where replication is ended by the special symbol moving out of the display area, the initial position may be restricted to a subset of positions that ensure there is at least one replication).

In an embodiment, the normal symbols are symbols in a spinning reel game. In this embodiment, the display positions correspond to display of a plurality of reels and display of at least one, and preferably a plurality of symbols, of each reel. For example, 5 reels with 3 symbols per reel. In this embodiment, the symbols may be selected by selecting a stop position for each of the reels.

In a second aspect, there is disclosed a gaming system comprising:

a display;

a symbol selector arranged to select at least a first set of normal symbols to be displayed by the display at a plurality of display positions and to cause a special symbol to be displayed at a display position;

a special symbol controller arranged to replicate an aspect of the special symbol until an end condition is met, the special symbol controller arranged to maintain each previously displayed special symbol in the display position where the special symbol occurred, select at least one display position for each replicated aspect of the special symbol and cause each replicated aspect of the special symbol to be displayed at the selected position; and an outcome generator arranged to determine at least one game outcome based on the displayed special symbol, the displayed normal symbols and the replicated aspect of the special symbol.

In a third aspect, there is disclosed a game controller comprising:

a symbol selector arranged to select at least a first set of normal symbols to be displayed by the display at a plurality of display positions and to cause a special symbol to be displayed at a display position;

a special symbol controller arranged to replicate an aspect of the special symbol until an end condition is met, the special symbol controller arranged to maintain each previously displayed special symbol in the display position where the special symbol occurred, select at least one display position for each replicated aspect of the special symbol and cause each replicated aspect of the special symbol to be displayed at the selected position; and an outcome generator arranged to determine at least one game outcome based on the displayed special symbol, the displayed normal symbols and the replicated aspect of the special symbol.

There is also disclosed computer program code which when executed by a computer causes the computer to implement a computer implemented method of gaming comprising:

selecting and displaying at least a first set of normal symbols at a plurality of display positions;

displaying a special symbol at a display position;

replicating an aspect of the special symbol until an end condition is met, the replication being performed by maintaining each previously displayed special symbol in the display position where the special symbol occurred, selecting at least one display position for the replicated aspect and displaying each replicated aspect of the special symbol at the selected position; and determining at least one game outcome based on the displayed special symbol, the displayed normal symbols and the replicated aspect of the special symbol.

BRIEF DESCRIPTION OF THE DRAWINGS

Certain embodiments of the invention will now be described in relation to the following drawings in which:

FIGS. 10A and 10B show exemplary displays of a fourth example;

FIGS. 11A and 11B show exemplary displays of a fifth example;

FIGS. 12A and 12B show exemplary displays of a sixth example;

FIGS. 13A and 13B show exemplary displays of a seventh example;

FIGS. 14A and 14B show exemplary displays of an eighth example;

FIGS. 15A and 15B show exemplary displays of a ninth example; and

DESCRIPTION OF CERTAIN EMBODIMENTS OF THE INVENTION

Figure 1:
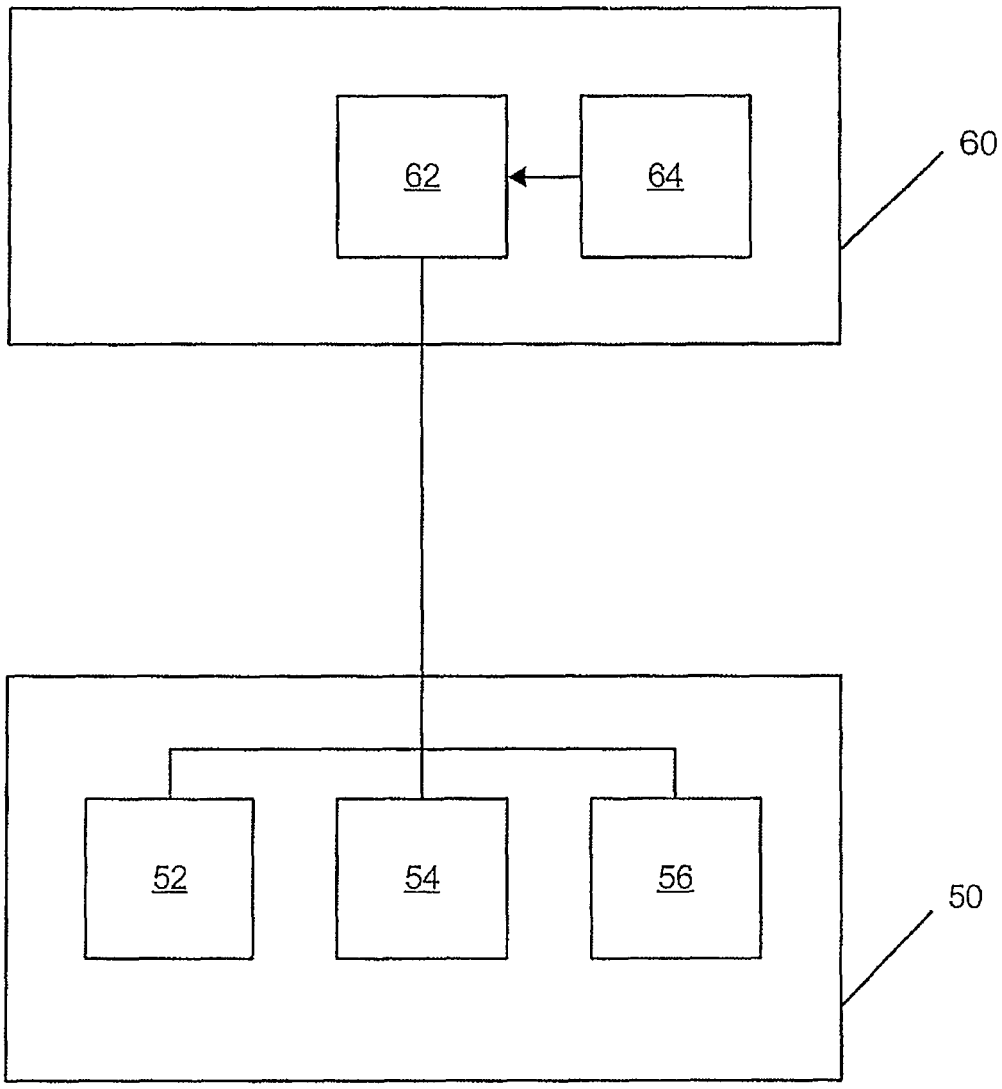
FIG. 1 is a block diagram of the core components of a gaming system.

Referring to the drawings, there is shown a gaming system arranged to implement a game wherein an aspect of special symbol, which may be a replicating special symbol or a replicating property associated with the special symbol, is replicated. The gaming system can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Irrespective of the form, the gaming system comprises several core components. At the broadest level, the core components are a player interface 50 and a game controller 60 as illustrated in FIG. 1. The player interface is arranged to enable manual interaction between a player and the gaming system and for this purpose includes the input/output components required for the player to enter instructions and play the game.

Components of the player interface may vary from embodiment to embodiment but will typically include a credit mechanism 52 to enable a player to input credits and receive payouts, one or more displays 54 and a game play mechanism 56 that enables a player to input game play instructions.

The game controller 60 is in data communication with the player interface and typically includes a processor 62 that processes the game play instructions in accordance with game play rules and outputs game play outcomes to the display. Typically, the game play instructions are stored as program code in a memory 64 but can also be hardwired. Herein the term "processor" is used to refer generically to any device that can process game play instructions in accordance with game play rules and may include: a microprocessor, microcontroller, programmable logic device or other computational device, a general purpose computer (e.g. a PC) or a server.

Figure 2:
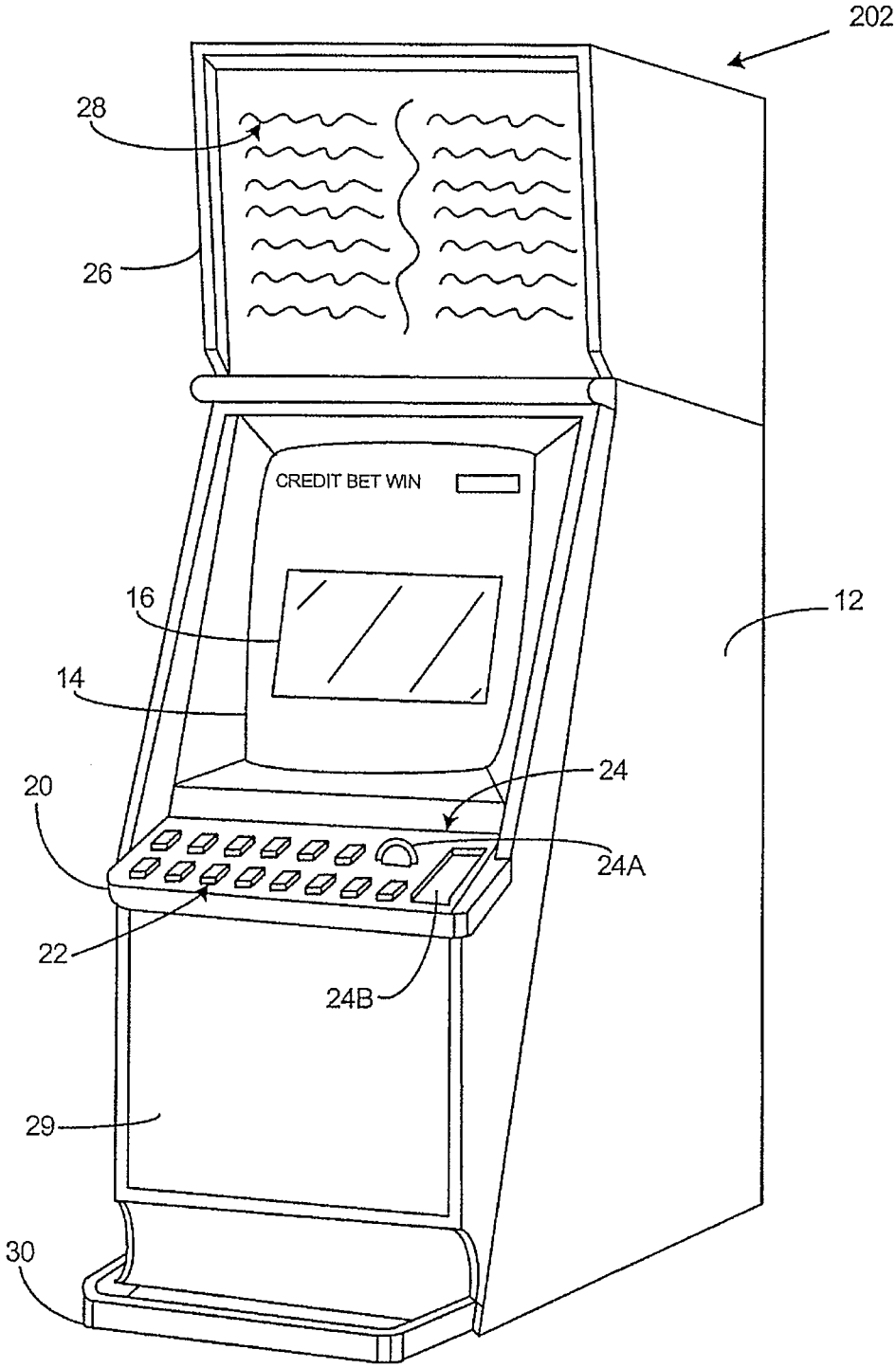
FIG. 2 is a perspective view of a gaming machine.

A gaming system in the form of a stand alone gaming machine 10 is illustrated in FIG. 2. The gaming machine 10 includes a console 12 having a display 14 on which is displayed representations of a game 16 that can be played by a player. A mid-trim 20 of the gaming machine 10 houses a bank of buttons 22 for enabling a player to interact with the gaming machine, in particular during gameplay. The mid-trim 20 also houses a credit input mechanism 24 which in this example includes a coin input chute 24A and a bill collector 24B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 26 may carry artwork 28, including for example pay tables and details of bonus awards and other information or images relating to the game. Further artwork and/or information may be provided on a front panel 29 of the console 12. A coin tray 30 is mounted beneath the front panel 29 for dispensing cash payouts from the gaming machine 10.

The display 14 shown in FIG. 2 is in the form of a video display unit, particularly a cathode ray tube screen device. Alternatively, the display 14 may be a liquid crystal display, plasma screen, any other suitable video display unit, or the visible portion of an electromechanical device. The top box 26 may also include a display, for example a video display unit, which may be of the same type as the display 14, or of a different type.

Figure 3:
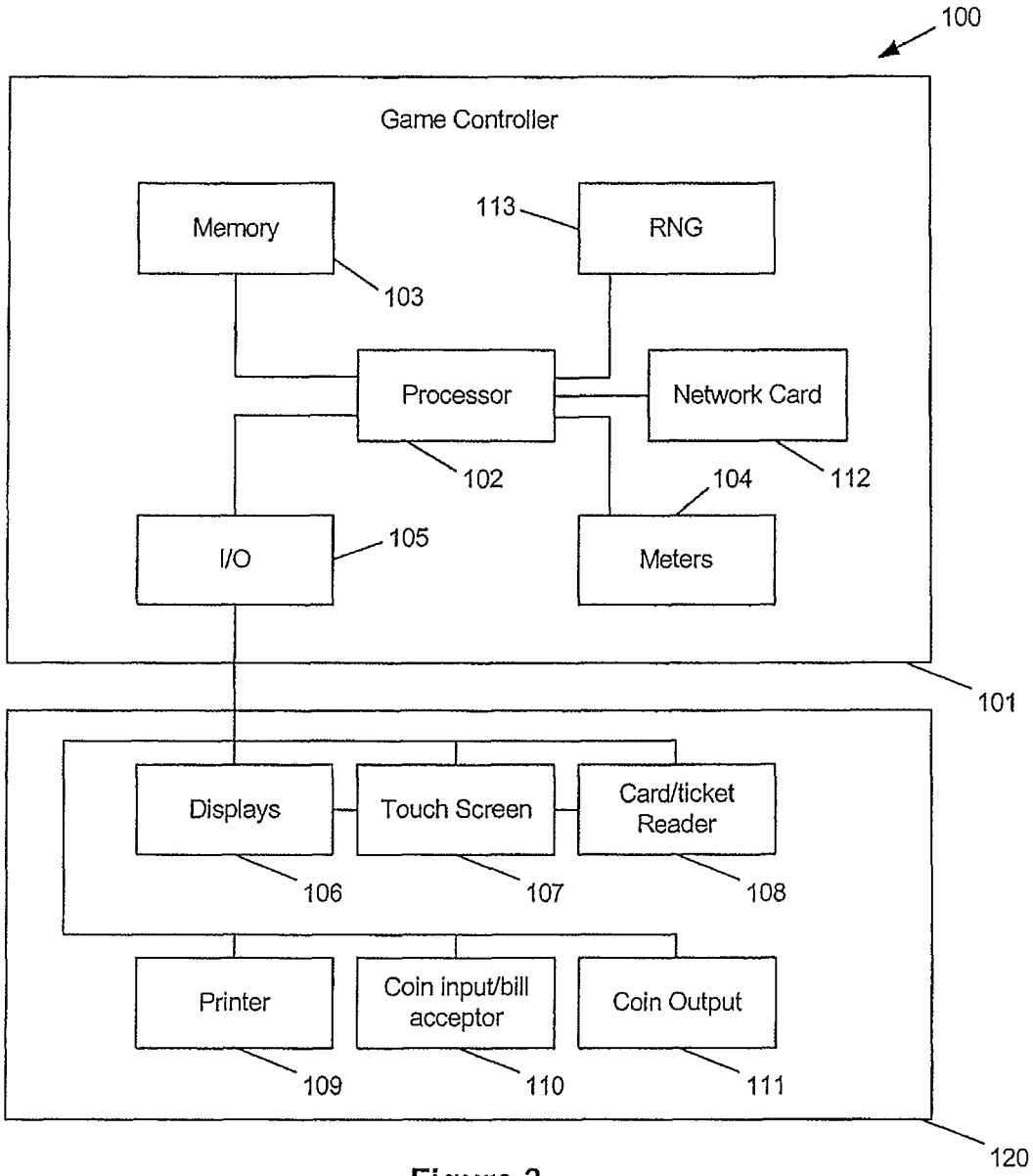
FIG. 3 is a block diagram of the functional components of a gaming machine.

FIG. 3 shows a block diagram of operative components of a typical gaming machine which may be the same as or different to the gaming machine of FIG. 2.

The gaming machine 100 includes a game controller 101 having a processor 102. Instructions and data to control operation of the processor 102 are stored in a memory 103, which is in data communication with the processor 102. Typically, the gaming machine 100 will include both volatile and non-volatile memory and more than one of each type of memory, with such memories being collectively represented by the memory 103.

The gaming machine has hardware meters 104 for purposes including ensuring regulatory compliance and monitoring player credit, an input/output (I/O) interface 105 for communicating with peripheral devices of the gaming machine 100. The input/output interface 105 and/or the peripheral devices may be intelligent devices with their own memory for storing associated instructions and data for use with the input/output interface or the peripheral devices. A random number generator module 113 generates random numbers for use by the processor 102. Persons skilled in the art will appreciate that the reference to random numbers includes pseudo-random numbers.

In the example shown in FIG. 3, a player interface 120 includes peripheral devices that communicate with the game controller 101 comprise one or more displays 106, a touch screen 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

Figure 4:
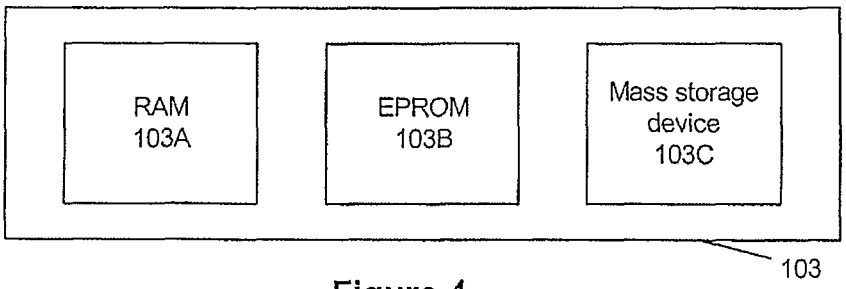
FIG. 4 is a block diagram representing the structure of a memory.

FIG. 4 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

It is also possible for the operative components of the gaming machine 100 to be distributed, for example input/output devices 106,107,108,109,110,111 to be provided remotely from the game controller 101.

Figure 5:
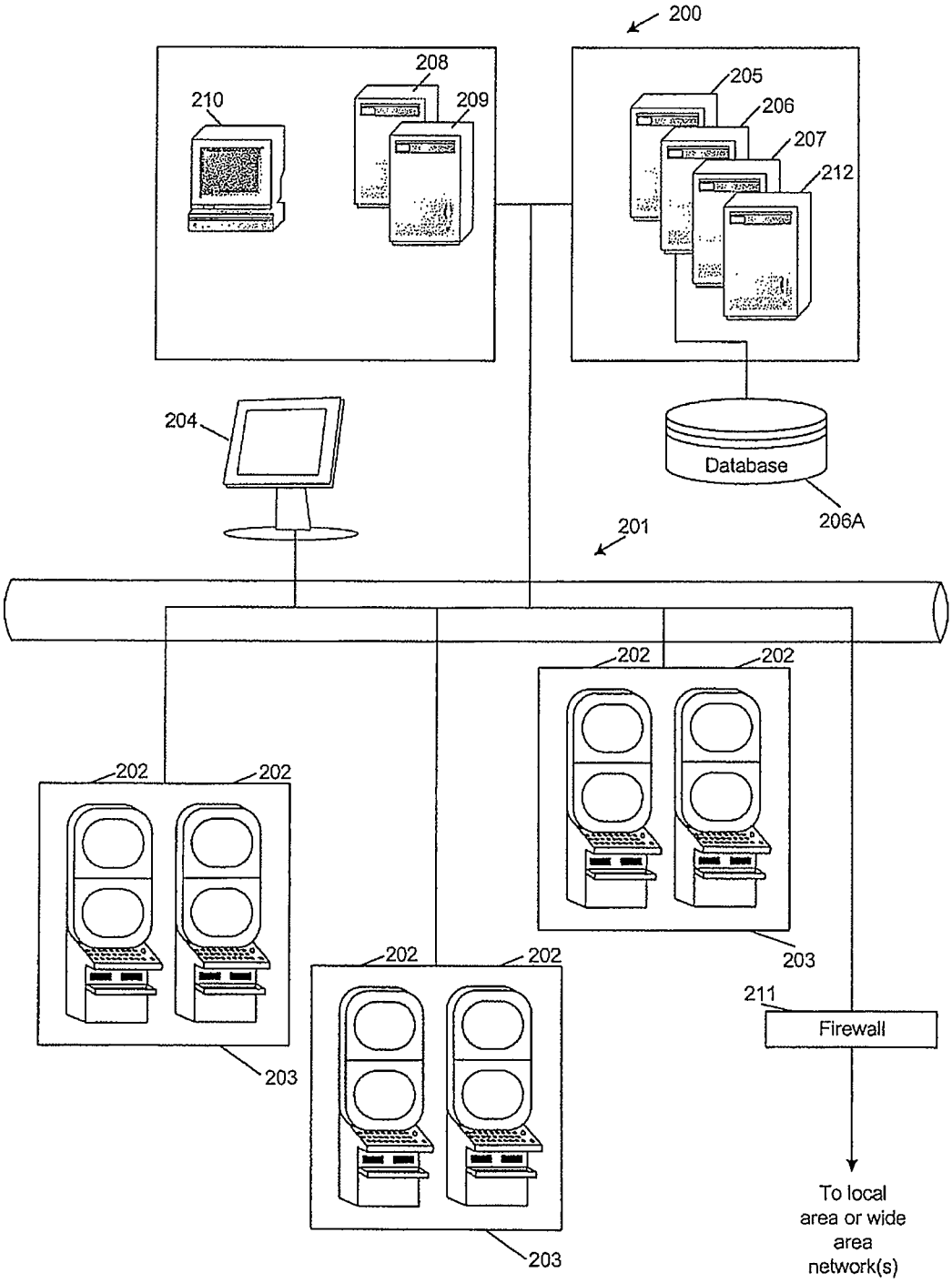
FIG. 5 is a diagram schematic of a networked gaming system.

FIG. 5 shows a gaming system 200 in accordance with an alternative embodiment. The gaming system 200 includes a network 201, which for example may be an Ethernet network. Gaming machines 202, shown arranged in three banks 203 of two gaming machines 202 in FIG. 5, are connected to the network 201. The gaming machines 202 provide a player operable interface and may be the same as the gaming machines 10,100 shown in FIGS. 2 and 3, or may have simplified functionality depending on the requirements for implementing game play. While banks 203 of two gaming machines are illustrated in FIG. 5, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, game server 205 implements part of the game played by a player using a gaming machine 202 and the gaming machine 202 implements part of the game. With this embodiment, as both the game server and the gaming device implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, game server 205 implements most or all of the game played by a player using a gaming machine 202 and the gaming machine 202 essentially provides only the player interface. With this embodiment, the game server 205 provides the game controller. The gaming machine will receive player instructions, pass these to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming network 200, including for example a gaming floor management server 208, and a licensing server 209 to monitor the use of licenses relating to particular games. An administrator terminal 210 is provided to allow an administrator to run the network 201 and the devices connected to the network.

The gaming network 200 may communicate with other gaming systems, other local networks, for example a corporate network, and/or a wide area network such as the Internet, for example through a firewall 211.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random generator engine. Alternatively, a separate random number generator server could be provided. Further, persons skilled in the art will appreciate that a plurality of games servers could be provided to run different games or a single game server may run a plurality of different games as required by the terminals.

Gaming systems for implementing games that involve a display of spinning reels as part of the display of the outcome of a game have either a video display or a mechanical display, these later machines most usually being "stepper" machines which have a separate motor for each reel.

The game controllers of such gaming machines have a stop determining function that determines the stop position for each reel. For example, if there are five reels, each having twenty symbols, the stop determining function might determine that the stop positions are positions: 3, 13, 7, 9 and 17. The spinning of the reels is then controlled so that each symbol comes to a stop in the same row, typically a predetermined row in a "window" visible to the player on the display that which corresponds to a player playing a single win line. When a reel stops, the symbols will be in one of a plurality of possible symbol positions for that reel relative to the stop position.

Embodiments of the present invention relate to gaming systems that allow a player to select how many win lines of a plurality of win lines they will play in each game—i.e. a minimum of one win line up to the maximum number of win lines allowed by the game. Each win line is formed by a set of symbol positions consisting of one symbol position from each reel. That is, a predetermined symbol position of each reel is assigned to a win line. The symbol positions that constitute each of the win lines are usually advertised to the player by markings on the display or diagrams showing the symbol positions that correspond to each win line. Some of the win lines will be horizontal or diagonal lines but others may be non-linear combinations of symbols. Typically, the win lines will be constituted by symbol positions in the visible window.

The gaming system implements a game wherein an aspect of a special symbol which may be a representation of a special symbol or a function associated with the special symbol is replicated. The gaming system will normally implement the game as a "feature". In one variation during the feature, a series of games are played during which a special symbol can occur. When a special symbol occurs it is held in the position at which it occurred until conclusion of the feature. Once the first special symbol occurs, the special symbol or a function associated with the special symbol is replicated by selecting at random another display position, preferably adjacent to the originating position. The special symbol or function will in some embodiments replicate a number of times until an end condition is met. The end condition may be, for example, that a predetermined number of replicated special symbols have appeared on the display or that a movement of the special symbol from the previous position would result in the special symbol moving outside of the display area.

In an embodiment, the special symbol is a wild symbol which substitutes for some or all of the other normal symbols. As indicated above, the gaming system is normally employed in relation to a spinning reel game and the special symbol is a symbol on one of the reels used during the feature game. The special symbol controller starts replicating if it appears from a result of a spin of the reel. In an alternative embodiment, one or more combinations of normal symbols will provide a start condition that results in the display of the special symbol, in place of one of the normal symbols (for example by random selection of a position for the special symbol).

In one embodiment, the aspect of the special symbol to be replicated is a function such as a multiplier function, a scatter function or a wild function.

In an alternative embodiment, the special symbol is "transparent" and has an associated function which serves to multiply the value of the prize. The special symbol is transparent in the sense that it is also possible to perceive the normal symbol in its display position with the special symbol superposed next to the normal symbol. In the case of a video display, this is achieved by displaying both symbols in the same display position. In a mechanical machine, this can be achieved by using one or more superimposed "transparent reels" that only show the special symbol.

In another embodiment, the special symbol is a wild symbol and also has a multiplier function associated with the special symbol which serves to multiply the value of the prize, or is initially wild and multiplies the value of the prize if a second special symbol appears in the same display location.

In another alternative, there is more than one special symbol. In a further alternative, the special symbol is a jackpot symbol.

In another alternative, a special symbol has more than one associated function and the system randomly, or in accordance with a defined scheme, selects one or more of the functions to be replicated to a selected display position.

In another alternative, a special symbol has an associated function which only affects game outcomes when replicated.

A player's eligibility for the feature can be determined in accordance with any known eligibility rule including but not limited to:

the feature being available to all players for all bets;

the feature being available for certain bets only, different levels of the game being available for different bets. For example, standard bets are entitled to one special symbol, additional bets are entitled to an additional special symbol.

The commencement of the feature can be in accordance with any of the known rules including but not limited to:

commencing when a symbol or a combination of symbols appear in the window;

commencing when a time has elapsed;

commencing when a turnover has elapsed;

commencing when a system event occurs or commencing when a game event occurs such as an underlying random event.

The initial special symbol can occur in various ways including but not limited to randomly through spinning of the reels in which case it might not appear; or placing the symbols in a random process in response to a start condition being met, thus ensuring at least one special symbol occurs.

In addition to the above described end conditions, the feature may be ended when a replicating symbol locates to a special position on the reels, or when a replicating symbol locates on a position of the reels which is occupied by different special symbol. For example if a replicating mouse symbol moves to a position occupied by a cat symbol.

In one embodiment, the selection of a random location is made by the game controller using a random number generator as described in further detail below. The random number generator can be used to follow a pathways algorithm or the location can be determined at each new location using a probability table.

In an alternative embodiment, symbols which are susceptible to replacement by a replicated symbol or which are susceptible to receiving a replicated function are tagged with a visible identifier such as a "+" identifier. With this embodiment, the tagged symbols may be selected at random for replacement with a replicated symbol or reception of a replicated function.

In an alternative embodiment, symbols which are susceptible to replacement by a replicated symbol or which are susceptible to receiving a replicated function are not tagged and, instead, displayed symbols which are not susceptible to replacement by a replicated symbol or which are not susceptible to receiving a replicated function are tagged with a visible identifier such as a "+" identifier.

In some embodiments, the reels are spun again after each special symbol occurs. That is, once the special symbol appears, the first game outcome is determined, the reels are re-spun and a symbol or function associated with a symbol is replicated then a second game outcome is evaluated with the process continuing until the second condition is met.

In other embodiments, the reels are not re-spun while the special symbol or function associated with the special symbol is replicated. In one variation of this embodiment, the game outcomes are determined after each replication. In another variation, the game outcome is only determined once all replications have occurred.

Figure 16:
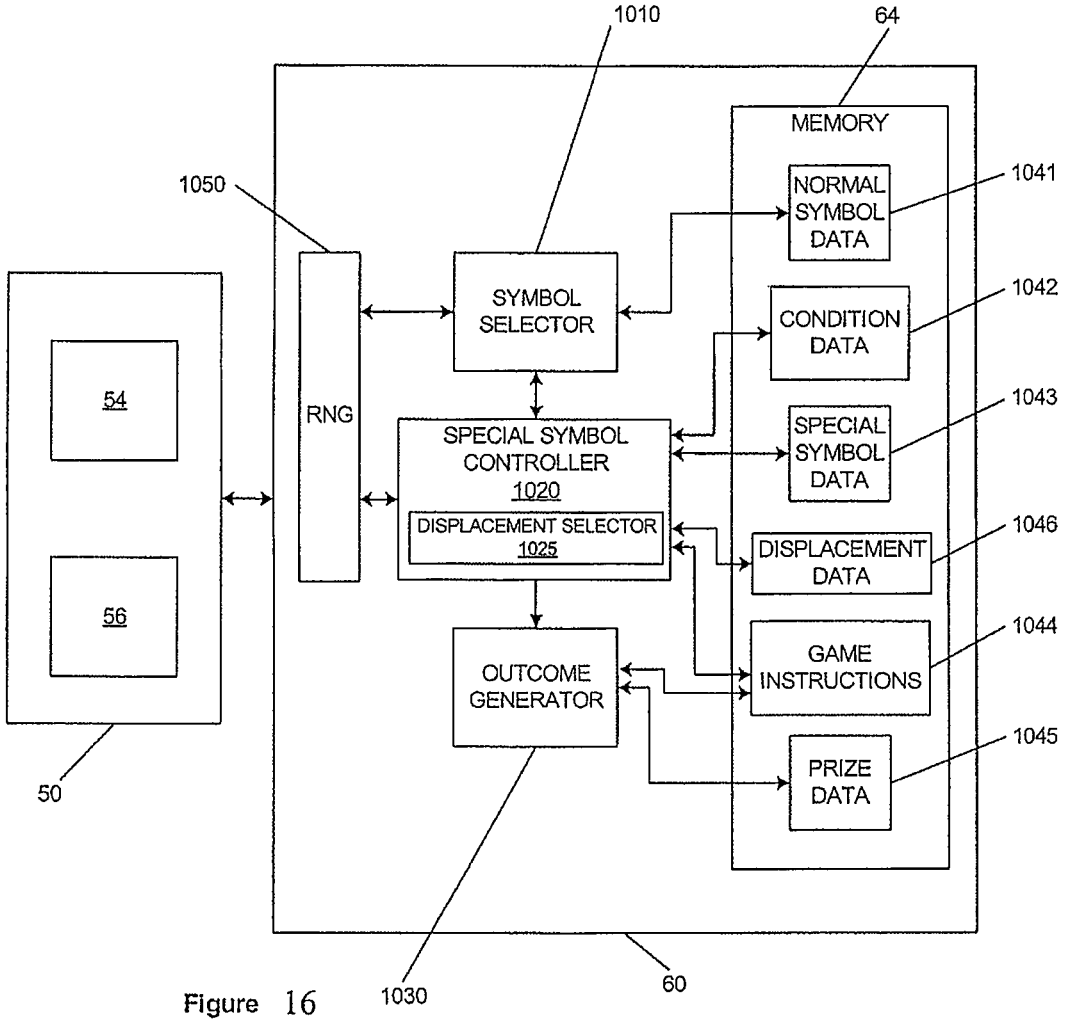
FIG. 16 is a further block diagram of a gaming system.

A gaming system for implementing the invention is illustrated in FIG. 16. (Where possible the same numbering as FIG. 1 is used.) The gaming system comprises a symbol selector 1010 that may be in the form of a reel controller for selecting stop positions of a reel. The symbol selector 1010 obtains values from random number generator 1050 to select symbols from a set of available symbols for each of a plurality of reels. That is, symbol data 1041 may specify the configuration of each of the reels or otherwise specify the symbols that may be selected.

The symbol selector 1010 includes a special symbol controller 1020 that determines, based on condition data 1042, whether a start condition has been met. As described above, the start condition may be that a particular combination of symbols has been selected by the symbol selector 1010, or a special symbol has been selected by the symbol selector 1010.

Depending on the embodiment, the outcome generator determines, based on the game instructions 1044 and the prize data 1045, whether a game outcome (e.g. an award of credits) should be generated based on the combination of special symbol(s) and normal symbols now displayed on display 54.

The special symbol controller 1020 then determines whether an end condition specified in condition data 1042 has been met. Assuming the end condition has not been met, the special symbol controller 1020 replicates the special symbol, in one embodiment by randomly determining the new position for the replicated symbol by selecting a movement from a set of possible movements specified in movement data 1046 using a value obtained from random number generator 1050. Movement data may define, for example, whether the special symbol should be replicated in an adjacent display position or moved by a "dance step"—e.g. two steps in one direction and one step in another direction. In a variation, the replicated position may be selected at random. The game continues with the special symbol controller 1020 replicating symbols until game instructions 1044 specifies that an end condition has been met.

EXAMPLE 1

A five by three spinning reel game is being played at one credit per line and five lines. The game pays prizes in a left to right pattern only. Three scattered coin symbols appear on the reels and trigger a series of five feature games. The feature is available for all bets.

During the feature games, the rules of the game define that the "Star" symbol is wild and therefore has the function of substituting for all other symbols. During the feature, once a Star symbol stops on a reel, the symbol will remain in the original position for all remaining games in this feature sequence. When the reels spin, they spin "behind" the wild Star. In addition, once a Star symbol appears, on the next spin of the reels, another Star symbol will appear on the reels and will locate adjacent to the existing Star. Adjacent is defined as being above or below or left or right of the existing symbol.

Please note that in this case, the meaning of the word "above" includes moving from the top line to the bottom line on the same reel. Similarly, the word "below" includes moving from the bottom line to the top line on the same reel. Similarly the word "left" includes moving from reel one to reel five and "right" includes moving from reel five to reel one. That is, the left and right sides and the top and bottom lines are treated as contiguous.

The game randomly selects at which position to locate the additional star. If the replicating star locates at a position already occupied by a star, then two stars are shown at that location and the prize is doubled. Similarly if further stars replicate to the same position.

In the first free game, a Star symbol does not stop on the reels. The symbols appearing on the reels are evaluated and prizes paid. That is, the Star symbol must appear on the reels before it is replicated.

Figure 6A:
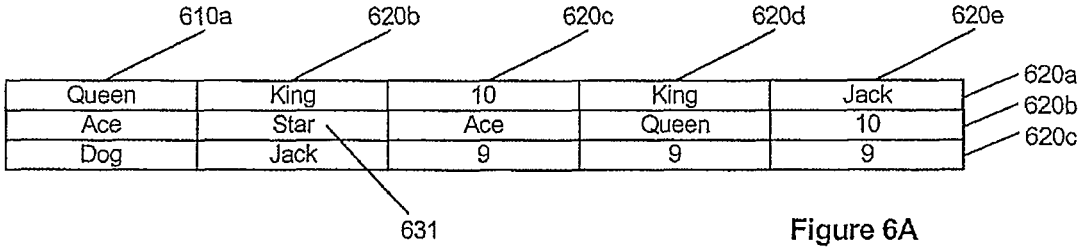
FIGS. 6A to 6D show exemplary displays of a first example.

In the second free game, a Star symbol 631 stops on reel two 610*b* in the centre row 620*b*. The symbols appearing in the window are evaluated for prizes according to the bet options placed by the player and using the Star as a substitute. The outcome is shown in FIG. 6A This outcome pays 3*Aces on the centre line (Star substitutes for the Ace)

Figure 6B:
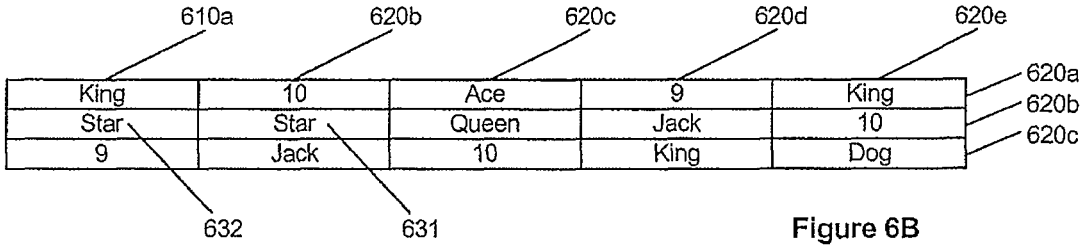

In the third free game, the Star 631 remains in the location and an additional star 632 appears and is located adjacent to the original Star. The movement is random but can only be above or below on reel two or sideways on reel one or reel three. The reels also spin and all other nominal symbols are replaced. The outcome is shown in FIG. 6B with the latest symbol 632.

The outcome pays

3*Queens on the centre line (Star substitutes for Queen)

2*9 on the fifth payline (bottom left corner up to middle top then down to bottom right hand corner)

Figure 6C:
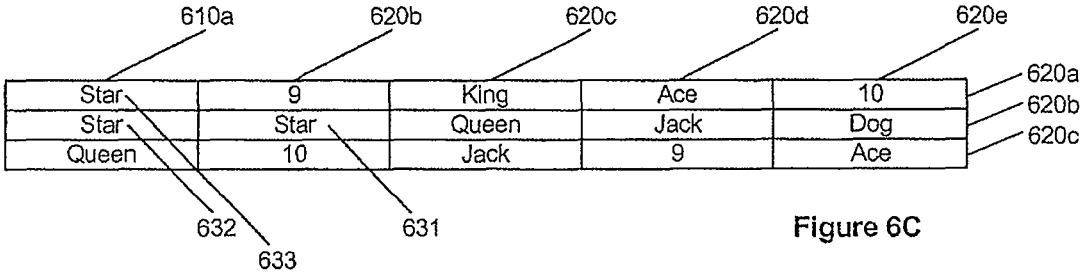

In the fourth free game, the Stars 631,632 remain available in the original positions and an additional star 633 appears and is located adjacent to the last Star created. The new location 633 is random but can only move up or down on reel one or sideways onto reel five or reel two. The reels also spin and all other symbols are replaced. The outcome is shown in FIG. 6C.

The outcome pays

3*Queens on the centre line (Star substitutes for Queen)

2*9 on the top line (Star substitutes for nine)

4*Jacks on the fourth payline (top left hand corner to middle bottom, then up to top right hand corner. (Star substitutes for Jack)

Figure 6D:
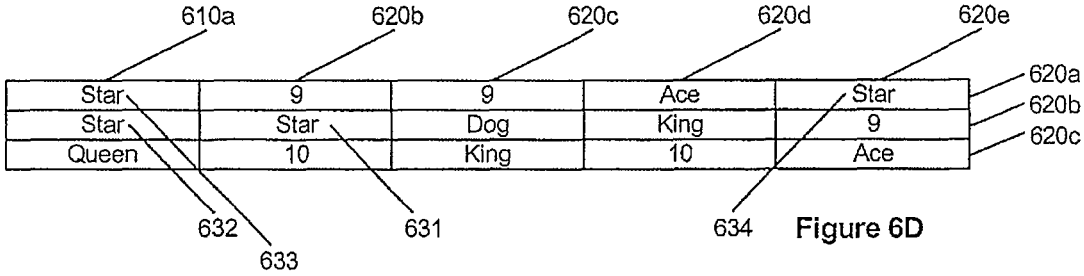

In the fifth free game, the Star symbols 631,632,633 remain in their positions and an additional star symbol 634 appears. The additional star 634 is located by random but can only be above (to the bottom position) or below on reel one or sideways onto reel five or reel two. The reels also spin and all other symbols are replaced. The outcome is shown in FIG. 6D.

The outcome pays

3*9 on top line. (Star substitutes for nine)

3*Dog on the centre line

5*King on the fourth payline

Five feature games are now complete and the game returns to normal play.

Figure 7:
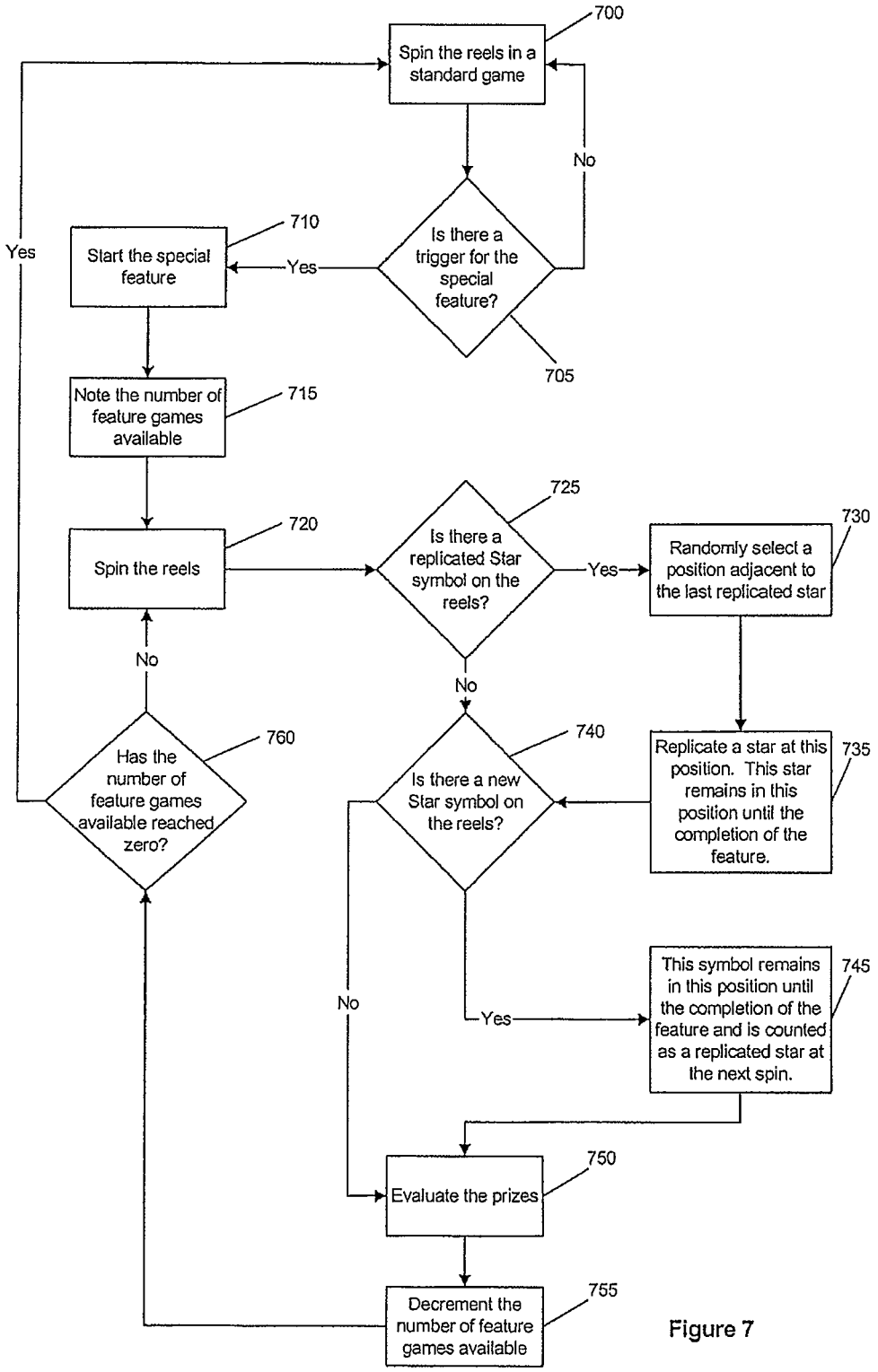
FIG. 7 is a flowchart of the first embodiment.

This game is summarised in the flow chart of FIG. 7. At step 700, the reels are spun in a standard game. At step 705, it is determined whether there is a trigger (a start condition) for the special feature. The game then involves starting the special feature 710 before a record is made of the number of special games available 715. The reels are then spun 720. It is determined at step 725 whether there is a replicated Star symbol on the reels. If the answer is no, it is determined at step 740 whether there is a new Star symbol on the reels. If the answer is no, the prizes are evaluated. If the answer is yes, this symbol remains in position until the completion of the feature and is counted as a replicated Star at the next spin. At step 750, the prizes are evaluated and at step 755 the number of feature games available is decremented. At step 760 it is determined whether the number of feature games available reaches zero. At step 720, the reels are spun again. By now there will be a replicated Star symbol on the reels determined at Step 725. Accordingly, at step 730, the game involves randomly selecting a position adjacent to the last replicated Star. At step 735 the Star is replicated by being displayed at the selected position. The Star remains in this position until completion of the feature. It is determined whether there is a new Star symbol on the reels at step 740, and the symbol will remain in that position until the feature ends and is counted as a replicated Star at the next spin. The prizes are again evaluated at step 750. The process continues until the number of feature games is exhausted and thus, the end condition is met.

EXAMPLE 2

A five by three spinning reel game is being played at 1 credit per line and five lines. The game pays prizes in a left to right pattern only. Three scattered coin symbols appear on the reels and trigger a series of five feature games. The feature is available for all bets.

During the feature games, the rules of the game define that at the commencement of the feature games a "Star" symbol appears on a reel and acquires the function of substituting for all other symbols except coin. Once the "Star" is located, the prizes are evaluated and paid. The symbol then remains in that position for all remaining games in this feature sequence. Another "Star" symbol will appear on the reels and will randomly locate adjacent to the existing Star. Adjacent is defined as being above or below or left or right of the existing symbol.

Please note that the meaning of the word "above" includes moving from the top line to the bottom line on the same reel. Similarly, the word "below" includes moving from the bottom line to the top line on the same reel. Similarly the word "left" includes moving from reel one to reel five and "right" includes moving from reel five to reel one.

If the replicating star locates at a position already occupied by a star, then two stars are shown at that location and the prize is doubled. Similarly if further stars replicate to a position already occupied by a star.

Figure 8A:
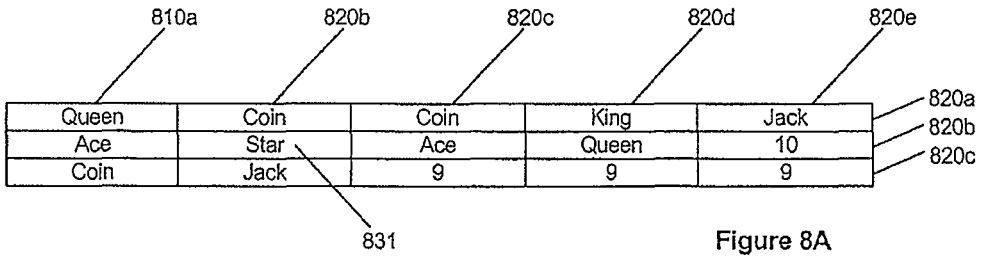
FIGS. 8A to 8E show exemplary displays of a second example.

In the first free game, a Star symbol 831 is displayed on reel two 810*b* in the centre position 820*b* as illustrated in FIG. 8A. The symbols appearing in the window are evaluated for prizes according to the bet options placed by the player and using the Star as a substitute.

This outcome pays 3 scattered coins

3*Aces on the centre line (Star substitutes for the Ace)

Figure 8B:
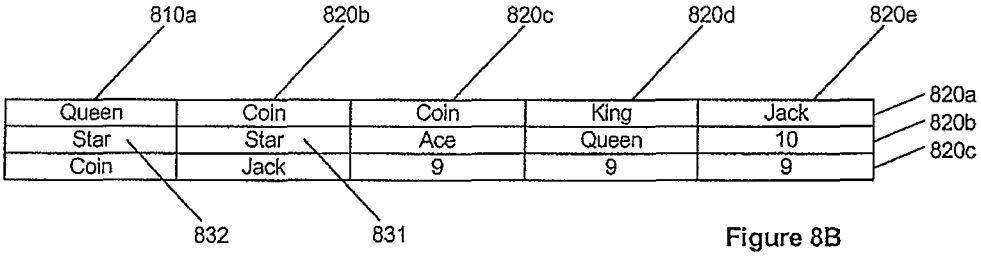

In the second free game, the Star 831 remains in the location and an additional star 832 appears and is located adjacent to the original Star. The movement is random but can only be above or below on reel two or sideways on reel one or reel three. The outcome is shown in FIG. 8B.

The outcome pays 3 scattered coins

3*Ace on the centre line (Star substitutes for Ace)

Figure 8C:
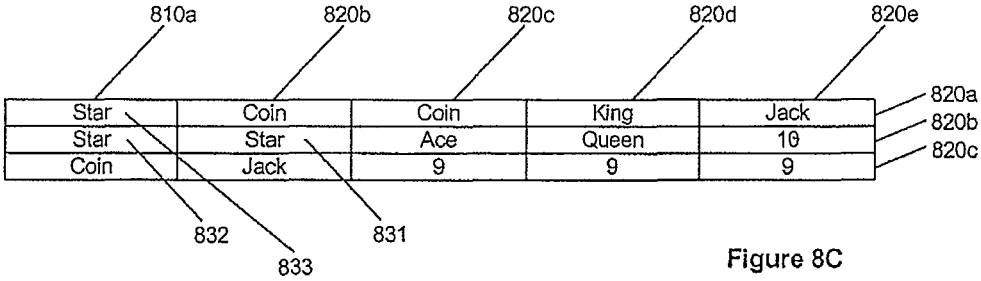

In the third free game, the Stars 831,832 remain available in the original positions and an additional star 833 appears and is located adjacent to the last Star created. The new location is random but can only move up or down on reel one or sideways onto reel five or reel two. The outcome is shown in FIG. 8C.

The outcome pays 3 scattered coins

3*Ace on the centre line (Star substitutes for Ace)

3*9 on the fourth payline (top left hand corner to middle bottom, then up to top right hand corner. (Star substitutes for 9)

Figure 8D:
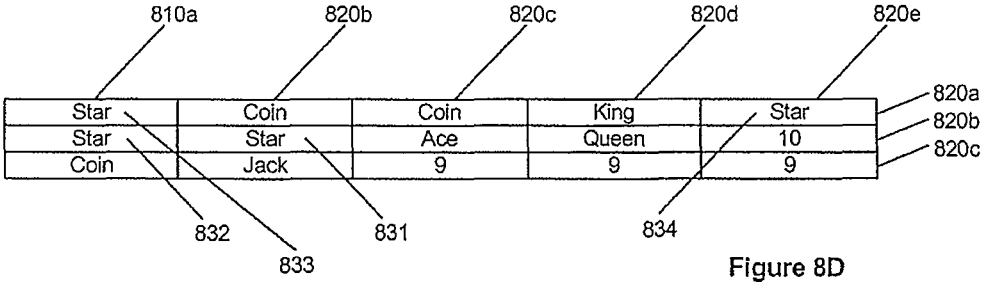

In the fourth free game, the Star symbols 831,832,833 remain in their positions and an additional star symbol appears. The additional star is located by random but can only move above (to the bottom position) or below on reel one or sideways onto reel five or reel two. The outcome is shown in FIG. 8D.

The outcome pays 3 scattered coins

3*Ace on the centre line

3*9 on fourth payline. (Star substitutes for 9)

Figure 8E:
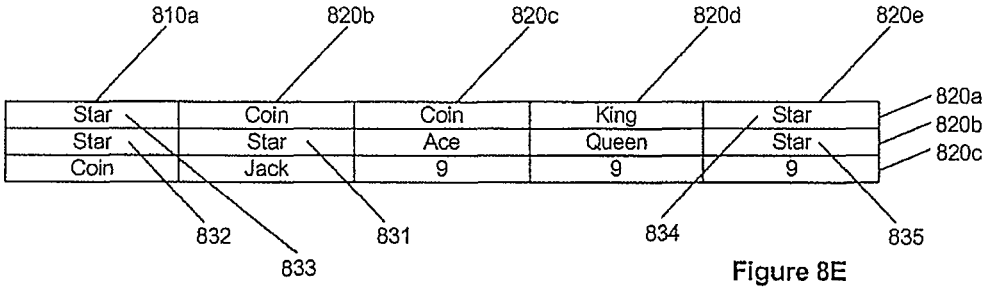

In the fifth free game, the Star symbols 831,832,833,834 remain in their positions and an additional star symbol 835 appears. The additional star is located by random but can only move above (to the bottom position) or below on reel five or sideways onto reel one or reel four. The outcome is shown in FIG. 8E.

The outcome pays 3 scattered coins

3*Ace on the centre line

3*9 on fourth payline. (Star substitutes for 9)

Five feature games are now complete and the game returns to normal play.

EXAMPLE 3

No Spin Between Replication and Prize Evaluation at the Conclusion

A five by three spinning reel game is being played at 1 credit per line and five lines. The game pays prizes in a left to right pattern only. Three scattered coin symbols appear on the reels and trigger a series of feature games. Feature games conclude when the special symbol "falls off the edge". At the conclusion of the games, the prize is evaluated.

During the feature games, the rules of the game define that at the commencement of the feature games a "Penguin" symbol appears on a reel and acquires the function of substituting for all other symbols except coin. Once the "Penguin" is located, another penguin symbol locates randomly adjacent to the existing Penguin. Adjacent is defined as being above or below or left or right of the existing symbol.

If the penguin locates above the reels or below the reels or to either side of the reels (i.e. outside of the display area), then the penguin has "fallen off the edge" and the feature ceases as a second condition is met.

If the replicating penguin locates at a position already occupied by a penguin, then two penguins are shown at that location and the prize is doubled. Similarly if further penguins replicate to a position already occupied by a penguin.

Figure 9A:
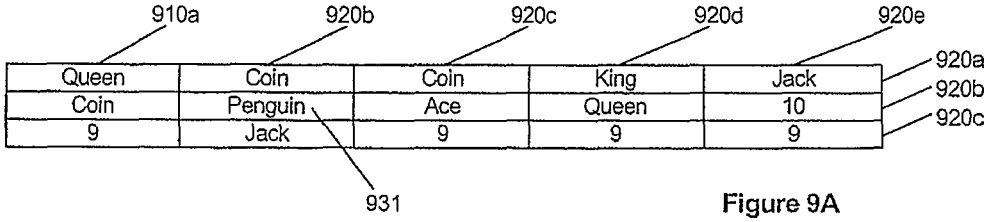
FIGS. 9A to 9G show exemplary displays of a third example.

In the first free game, a Penguin symbol 931 appears on reel two in the centre position. The symbols appearing in the window are shown in FIG. 9A.

Figure 9B:
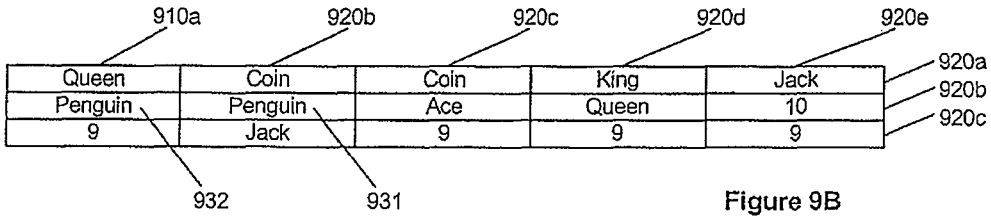
Figure 9C:
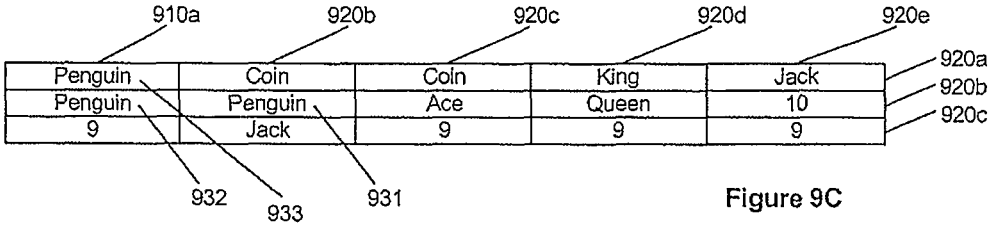

In the second free game, the Penguin 931 remains in the location and an additional Penguin 932 appears and is located adjacent to the original Penguin. The movement is random but can only be above or below on reel two or sideways on reel one or reel three. The outcome is shown in FIG. 9B In the third free game, the Penguin 931,932 remains available in the original positions and an additional Penguin 933 appears and is located adjacent to the last Penguin created. The new location is random but can only move up or down on reel one or sideways onto reel two. If the penguin moves sideways to the left of reel 1, the penguin will fall off the reels and the game will conclude. The outcome is shown in FIG. 9C.

Figure 9D:
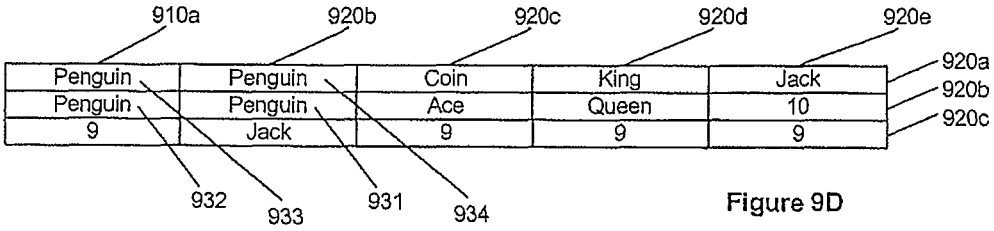

In the fourth free game, the Penguin symbols 931,932,933 remain in their positions and an additional Penguin symbol 934 appears. The additional Penguin is located by random but can only move below on reel one or sideways onto reel two. If the penguin moves left or up, the penguin falls off the reels and the game concludes. The outcome is shown in FIG. 9D.

Figure 9E:
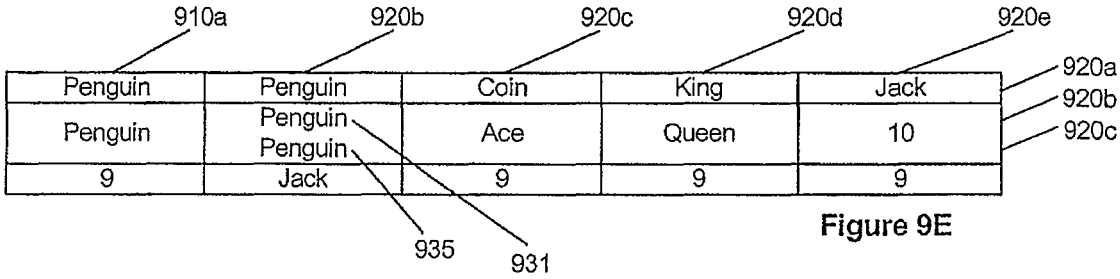

In the fifth free game, the Penguin symbols 931,932,933, 934 remain in their positions and an additional Penguin symbol 935 appears. The additional Penguin is located by random but can only move below on reel 2 or sideways onto reel 1 or reel 3. The outcome is shown in FIG. 9E.

Figure 9F:
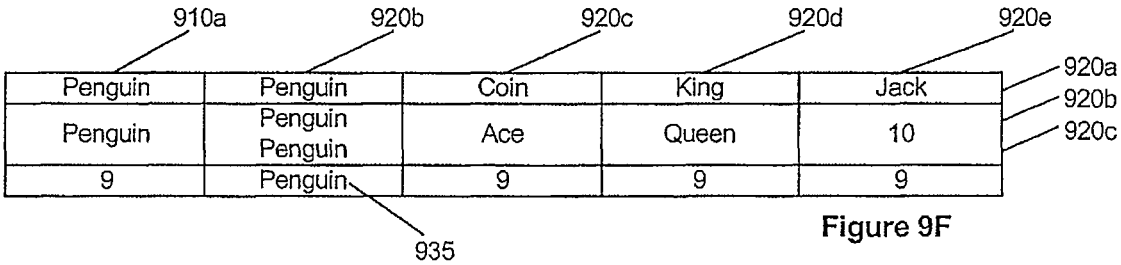
Figure 9G:
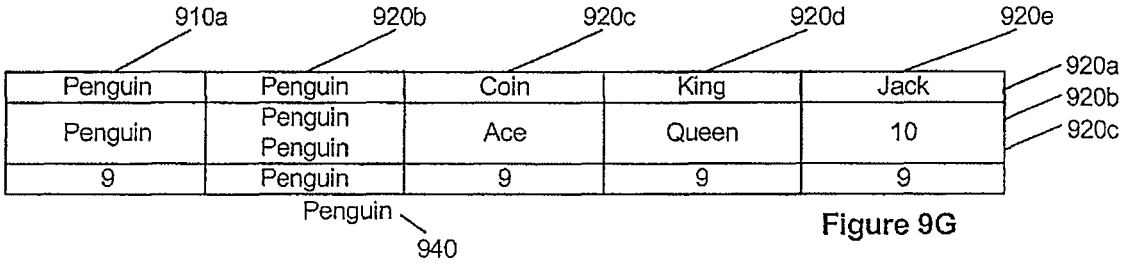

In the sixth free game, the Penguin symbols 931,932,933, 934,935 remain in their positions and an additional Penguin symbol 936 appears. The additional Penguin is located by random but can only move up and down on reel two or sideways onto reel one or reel three. The outcome is shown in FIG. 9F.

In the seventh free game, the Penguin symbols 931,932, 933,934,935,936 remain in their positions and an additional Penguin symbol 940 appears. The additional Penguin is located by random but can only move above on reel 2 or sideways onto reel 1 or reel 3. The outcome is shown in FIG. 9E. The Penguin 940 has moved outside the display area and the feature is now complete.

The prizes are now evaluated and paid as follows:—

3*Ace on the centre line with prizes doubles (two penguins on reel two)

5*9 on the bottom line

3*9 on fourth payline with prizes doubled

2*9 on fifth payline with prizes doubled.

EXAMPLE 4

A five by three spinning reel game is being played at 1 credit per line and five lines. The game pays prizes in a left to right pattern only. A player places a special bet which entitles the player to commence a feature game.

During the feature game, the rules of the game define that WILD symbols appearing on a reel 1060*a*, 1060*b*, 1060*c*, 1060*d*, 1060*e* are treated as special symbols, and the WILD symbol and associated wild function are replicatable to other display positions.

At the commencement of the feature game, a player is required to press an "infect" button which causes all symbols displayed at positions adjacent the WILD symbol above, below, left or right to receive a WILD symbol, but only if replacement with a WILD symbol would result in a win outcome.

In the present example, the symbols initially appearing in the window are shown in FIG. 10A. A WILD symbol 1062 is displayed on the centre line of reel two 1060*b*.

The WILD symbol 1062 then replicates to the centre line of reel one, the centre line of reel three and the bottom line of reel two such that a WILD symbol 1064 is added to the symbols originally at those positions, as shown in FIG. 10B. A WILD symbol is not replicated to the top line of reel two because no improvement would occur.

The prizes are evaluated and paid as follows:—

3*King on the centre line

3*Jack on the centre line

3*10 on the bottom line

EXAMPLE 5

A five by three spinning reel game is being played at 1 credit per line and five lines. The game pays prizes in a left to right pattern only.

During the feature game, the rules of the game define that "bee" symbols appearing on a reel 1100*a*, 1100*b*, 1100*c*, 1100*d*, 1100*e* are treated as special symbols having associated wild and doubling functions which are replicatable to other display positions. However, with this embodiment, the "bee" symbol itself does not provide a wild or doubling function; the wild and doubling functions only affect game outcomes when replicated to other display positions.

At the commencement of the feature game, a player is required to press an "infect" button which causes all symbols displayed at positions adjacent a displayed "bee" symbol above, below, diagonal, left or right to be replaced with a WILD doubling symbol.

In the present example, the symbols initially appearing in the window are shown in FIG. 11A. A "bee" symbol 1110 is displayed on the centre line of reel four 1100*d*.

The "bee" symbol 1110 then replicates the wild and doubling functions to the top line of reel three, the centre line of reel three, the bottom line of reel three, the top line of reel four, the bottom line of reel four, the top line of reel five, the centre line of reel five and the bottom line of reel five such that a wild doubling symbol 1120 replaces the symbols originally at those positions, as shown in FIG. 11B.

The prizes are evaluated and paid as follows:—

3*King on the centre line with the prize doubled.

EXAMPLE 6

A five by three spinning reel game is being played at 1 credit per line and five lines. The game pays prizes in a left to right pattern only.

During the feature game, the rules of the game define that a symbol appearing on a reel 1200*a*, 1200*b*, 1200*c*, 1200*d*, 1200*e* and tagged as "infected" is treated as a special symbol and a function associated with the tagged symbol is replicatable to other display positions. The rules of the game also define that only symbols which are tagged as susceptible of "infection" may receive the function. In this example, the function associated with an "infected" symbol and which is replicated to other symbols is a doubling function.

At the commencement of the feature game, one or more symbols which are susceptible of "infection" disposed adjacent an "infected" symbol are randomly selected to receive the function associated with the "infected" symbol, and the newly "infected" symbol in turn randomly "infects" at least one adjacently disposed symbol susceptible of infection, and so on.

In the present example, the symbols initially appearing in the window are shown in FIG. 12A. An "infected" symbol 1210 is displayed on the centre line of reel one 1200*a*, and symbols susceptible of infection 1220 are displayed on the centre and bottom lines of reel two 1200*b*, on the centre line of reel three 1200*c*, and on the top and bottom lines of reel four 1200*d*.

As shown in FIG. 12B, the "infected" symbol 1210 then replicates to the centre line of reel two such that the symbol originally displayed at the centre line of reel two now becomes infected and capable of infecting other symbols. The "infected" symbol 1210 on the centre line of reel two 1200*b* then replicates to the centre line of reel three such that the symbol originally displayed at the centre line of reel three now becomes infected and capable of infecting other symbols. The "infected" symbol 1210 on the centre line of reel three 1200*c* then replicates to the top and bottom lines of reel four such that the symbols originally displayed at the top and bottom lines of reel four now become infected and capable of infecting other symbols.

Since reel five 1200*e* does not have any symbols which are susceptible of infection, the feature game is complete.

The prizes are evaluated and paid as follows:—

4*King on the centre line with the prize multiplied by 8 (2*2*2).

EXAMPLE 7

A five by three spinning reel game is being played at 1 credit per line and five lines. The game pays prizes in a left to right pattern only.

During the feature game, the rules of the game define that a symbol appearing on a reel 1300*a*, 1300*b*, 1300*c*, 1300*d*, 1200*e* and tagged as "infected" is treated as a special symbol and the tagged symbol is replicatable to all display positions disposed above, below, left or right of the "infected" symbol.

In the present example, the symbols initially appearing in the window are shown in FIG. 13A. A first "infected" symbol 1310 is displayed on the bottom line of reel two 1300*b* and a second "infected" symbol 1312 is displayed on the centre line of reel three 1300*c*.

As shown in FIG. 13B, the first "infected" symbol 1310 then replicates such that the symbols originally displayed above, and to the left and right of the first "infected" symbol 1310 are replaced with the first "infected" symbol 1310. Similarly, the second "infected" symbol 1312 then replicates such that the symbols originally displayed above, below, and to the left and right of the second "infected" symbol 1312 are replaced with the second "infected" symbol 1312.

The prizes are evaluated and paid as follows:—

5*PIC1 on the centre line

3*PIC1 on the bottom line.

EXAMPLE 8

A five by three spinning reel game is being played at 1 credit per line and five lines. The game pays prizes in a left to right pattern only.

During the feature game, the rules of the game define that a symbol appearing on a reel 1400*a*, 1400*b*, 1400*c*, 1400*d*, 1400*e* and tagged as "infected" is treated as a special symbol and a function associated with the tagged symbol is replicatable at random to one display position disposed above, below, diagonal, left or right of the "infected" symbol. In the present example, two functions are associated with an "infected" symbol, a WILD function and a SCATTER function, with the replicated function being randomly selected.

In the present example, the symbols initially appearing in the window are shown in FIG. 14A. A first "infected" symbol 1410 is displayed on the top line of reel two 1400*b*, a second "infected" symbol 1412 is displayed on the top line of reel three 1400*c*, a third "infected" symbol 1414 is displayed on the bottom line of reel three 1400*c*, and a fourth "infected" symbol 1416 is displayed on the top line of reel four 1400*d*.

The prizes are evaluated and paid as follows:—

3*Q on the centre line.

As shown in FIG. 14B, the first "infected" symbol 1410 then replicates such that the symbol originally displayed diagonally of the first "infected" symbol 1410 on the centre line of reel one 1400*a* is replaced with a SCATTER symbol, the second "infected" symbol 1412 then replicates such that the symbol originally displayed below the second "infected" symbol 1412 on the centre line of reel three 1400*c* is replaced with a SCATTER symbol, the third "infected" symbol 1414 then replicates such that the symbol originally displayed to the left of the third "infected" symbol 1414 on the bottom line of reel two 1400*b* is replaced with a SCATTER symbol, and the fourth "infected" symbol 1416 then replicates such that the second infected symbol 1412 originally displayed to the left of the fourth "infected" symbol 1414 is replaced with a WILD symbol.

The prizes are evaluated and paid as follows:—

3*K on the top line

Also, 3*SCATTER triggers a feature.

EXAMPLE 9

A five by three spinning reel game is being played at 1 credit per line and five lines. The game pays prizes in a left to right pattern only.

During the feature game, the rules of the game define that at least one symbol appearing on reel one 1500*a* and tagged as "infected" is treated as a special symbol and a function associated with the tagged symbol is replicatable to one display position disposed to the right of the "infected" symbol selected at random. The function associated with the newly "infected" symbol in turn is replicatable to one display position disposed to the right of the newly "infected" symbol selected at random. The number of symbols which are "infected" may be randomly selected and in this example 4 symbols are to be "infected".

In the present example, the symbols initially appearing in the window are shown in FIG. 15A. An "infected" symbol 1510 is displayed on the centre line of reel one 1500*a*. The function associated with the "infected" symbol 1510 and which is replicated to other symbols is a doubling function.

As shown in FIG. 15B, the "infected" symbol 1510 replicates such that a symbol displayed on the bottom line of reel two 1500*b* acquires the function associated with the "infected" symbol 1510 and itself becomes an "infectious" symbol 1512. The newly infected symbol 1512 replicates such that a symbol displayed on the centre line of reel three 1500*c* acquires the function associated with the "infected" symbol 1512 and itself becomes an "infectious" symbol 1514. The newly infected symbol 1514 replicates such that a symbol displayed on the bottom line of reel four 1500*d* acquires the function associated with the "infected" symbol 1514 and itself becomes an "infectious" symbol 1516.

The prizes are evaluated and paid as follows:—

3*Q on the centre line with the prize multiplied by 4 (2*2).

2*9 on the bottom line with the prize multiplied by 2.

Modifications and variations as would be apparent to a skilled addressee are deemed to be within the scope of the present invention.

The invention claimed is:

1. A method of gaming in which a feature game can be triggered during a play of a base game, the feature game having a plurality of display positions, the method as performed during the feature game comprising:

providing a symbol selector;

selecting at least a first set of normal symbols using said symbol selector, and displaying said first set of normal symbols at a plurality of the display positions;

displaying one special symbol of a particular type of a plurality of special symbols at one of the display positions;

providing a special symbol controller;

using the special symbol controller to replicate an aspect of said one special symbol of the particular type, to maintain the displayed said one special symbol of the particular type at said one of the display positions, to randomly select at least one display position of the plurality of display positions for display of the replicated aspect of said one special symbol of the particular type, and to display the replicated aspect of said one special symbol of the particular type at the randomly selected at least one display position if the randomly selected at least one display position does not already display a special symbol of the particular type of the plurality of special symbols, and if a particular display position corresponding to the at least one selected display position already displays a special symbol of the particular type, to display at the particular display position both (1) the special symbol of the particular type and (2) the replicated aspect of said one special symbol of the particular type;

providing an outcome generator;

determining using said outcome generator at least one game outcome based on (1) the displayed one special symbol of the particular type, (2) at least one of the displayed normal symbols and (3) the replicated aspect of said one special symbol of the particular type; and wherein said determining at least one game outcome includes providing an enhancement in the game outcome when both the special symbol of the particular type and the replicated aspect of said one special symbol of the particular type are displayed at the particular display position.

2. A method as claimed in claim 1, wherein said using the special symbol controller to replicate an aspect of said one special symbol of the particular type includes replicating the aspect of said one special symbol of the particular type as a representation of said one special symbol of the particular type.

3. A method as claimed in claim 1, wherein said using the special symbol controller to replicate an aspect of said one special symbol of the particular type includes replicating the aspect of said one special symbol of the particular type as a function associated with said special symbol of the particular type.

4. A method as claimed in claim 3, wherein said using the special symbol controller includes providing a plurality of functions associated with said one special symbol of the particular type, and selecting one function to be replicated from the plurality of functions.

5. A method as claimed in claim 3, wherein said using the special symbol controller includes providing a plurality of functions associated with said one special symbol of the particular type, and selecting all of the plurality of functions to be replicated.

6. A method as claimed in claim 1, wherein said using the special symbol controller includes randomly selecting at least one of a plurality of display positions adjacent to said one special symbol of the particular type.

7. A method as claimed in claim 6, wherein said randomly selecting includes randomly selecting a plurality of display positions adjacent to said one special symbol of the particular type.

8. A method as claimed in claim 6, wherein the display positions define a rectangular display area and the left side is treated as contiguous with the right side and the bottom is treated as contiguous with the top such that each selected display position adjacent the said one special symbol of the particular type corresponds to a display position within the rectangular display area.

9. A method as claimed in claim 6, wherein the display positions define a display area and the end condition to stop the feature game occurs when a randomly selected at least one display position would cause the replicated aspect of said one special symbol of the particular type to be outside the display area.

10. A method as claimed in claim 1, wherein said using the special symbol controller to display the replicated aspect of said one special symbol of the particular type includes replacing a normal symbol with the replicated aspect of said one special symbol of the particular type.

11. A method as claimed in claim 1, wherein said using the special symbol controller to display the replicated aspect of said one special symbol of the particular type includes adding the replicated aspect of said one special symbol of the particular type to a normal symbol at the randomly selected at least one display position.

12. A method as claimed in claim 1, wherein a plurality of the normal symbols each comprise a visible tag, and wherein said displaying said first set of normal symbols at a plurality of the display positions includes displaying a plurality of normal symbols which comprise a visible tag, and wherein said using the special symbol controller to display the replicated aspect of said one special symbol of the particular type at the randomly selected at least one display position if the randomly selected at least one display position does not already display a special symbol of the particular type includes adding the replicated aspect to only a display position having a normal symbol which comprises a visible tag.

13. A method as claimed in claim 1, wherein each of a plurality of the normal symbols do not comprise a visible tag, and wherein said displaying said first set of normal symbols at a plurality of the display positions includes displaying a plurality of normal symbols which do not comprise a visible tag, and wherein said using the special symbol controller to display the replicated aspect of said one special symbol of the particular type at the randomly selected of the least one display position if the randomly selected at least one display position does not already display a special symbol of the particular type includes adding the replicated aspect to only a display position having a normal symbol which does not comprise a visible tag.

14. A method as claimed in claim 1, wherein the end condition occurs when a predetermined maximum number of replications have been made.

15. A method as claimed in claim 1, wherein said displaying one special symbol of the particular type includes displaying said at least one special symbol of the particular type in response to a start condition.

16. A method as claimed in claim 15, and further comprising causing the start condition when the displayed said first set of normal symbols at a plurality of the display positions contains a predetermined symbol combination.

17. A method as claimed in claim 1, wherein determining at least one game outcome is performed after said one special symbol of the particular type is displayed and after the replicated aspect of said one special symbol of the particular type is displayed.

18. A method as claimed in claim 1, and further comprising selecting a further set of normal symbols using said symbol selector prior to said using the special symbol controller to replicate an aspect of said one special symbol of the particular type; and wherein said determining a game outcome includes determining at least one game outcome based on the further set of normal symbols and the special symbol of the particular type.

19. A gaming system arranged to implement a base game and wherein a feature game can be triggered during the base game, the gaming system comprising:

a display having a plurality of display positions;

a symbol selector configured to select at least a first set of normal symbols to be displayed by the display and to display 1) said first set of normal symbols at a plurality of the display positions, and 2) to display one special symbol of a particular type of the plurality of special symbols at one of the display positions;

a special symbol controller configured to replicate an aspect of said one special symbol of the particular type, the special symbol controller configured to maintain the displayed said one special symbol of the particular type at said one of the display positions, and to randomly select at least one display position of the plurality of display positions for display of the replicated aspect of said one special symbol of the particular type, and to display the replicated aspect of said one special symbol of the particular type at the randomly selected at least one display position if the randomly selected at least one display position does not already display a special symbol of the particular type of the plurality of special symbols, and if a particular display position corresponding to the at least one selected display position already displays a special symbol of the particular type, to display at the particular display position both (1) the special symbol of the particular type and (2) the replicated aspect of said one special symbol of the particular type; and an outcome generator configured to determine at least one game outcome based on (1) the displayed one special symbol of the particular type, (2) at least one of the displayed normal symbols, and (3) the replicated aspect of said one special symbol of the particular type, said outcome generator configured to provide an enhanced game outcome when both the special symbol of the particular type of said plurality of symbols and the replicated aspect of said one special symbol of the particular type are displayed at the particular display position.

20. A gaming system as claimed in claim 19, wherein the replicated aspect of said one special symbol of the particular type is a representation of said one special symbol of the particular type.

21. A gaming system as claimed in claim 19, wherein the replicated aspect of said one special symbol of the particular type is a function associated with said one special symbol of the particular type.

22. A gaming system as claimed in claim 21, wherein a plurality of functions are associated with said one special symbol of the particular type, and wherein said special symbol controller is configured to select one function to be replicated from the plurality of functions.

23. A gaming system as claimed in claim 21, wherein a plurality of functions are associated with said one special symbol of the particular type, and wherein said special symbol controller is configured to select all functions to be replicated from the plurality of functions.

24. A gaming system as claimed in claim 19, wherein said special symbol controller is configured to randomly select at least one display position of the plurality of display positions adjacent to said one special symbol of the particular type.

25. A gaming system as claimed in claim 24, wherein said special symbol controller is configured to randomly select a plurality of display positions adjacent to said one special symbol of the particular type.

26. A gaming system as claimed in claim 24, wherein the display positions define a rectangular display area and the left side is treated as contiguous with the right side and the bottom is treated as contiguous with the top such that each selected display position adjacent the said one special symbol of the particular type corresponds to a display position within the rectangular display area.

27. A gaming system as claimed in claim 24, wherein the display positions define a display area and the end condition to stop the feature game occurs when a randomly selected display position would cause the replicated aspect of said one special symbol of the particular type to be outside the display area.

28. A gaming system as claimed in claim 19, wherein said special symbol controller is configured to replace a normal symbol with the aspect of said one special symbol of the particular type.

29. A gaming system as claimed in claim 19, wherein said special symbol controller is configured to add the replicated aspect of said one special symbol of the particular type to a normal symbol at the randomly selected at least one display position.

30. A gaming system as claimed in claim 19, wherein a plurality of the displayed normal symbols each comprise a visible tag, and wherein said special symbol controller is configured to add the replicated aspect to only a display position having a normal symbol which comprises a visible tag.

31. A gaming system as claimed in claim 19, wherein each of a plurality of the displayed normal symbols do not comprise a visible tag, and wherein said special symbol controller is configured to select only display positions having normal symbols which do not comprise a visible tag.

32. A gaming system as claimed in claim 19, wherein the end condition to stop the feature game occurs when a predetermined maximum number of replications have been made.

33. A gaming system as claimed in claim 19, wherein the symbol selector is configured to display said at least one special symbol of the particular type in response to a start condition.

34. A gaming system as claimed in claim 33, wherein said start condition occurs when said first set of normal symbols displayed at a plurality of display positions contains a predetermined symbol combination.

35. A gaming system as claimed in claim 19, wherein said outcome generator is configured to determine at least one game outcome after said one special symbol of the particular type is displayed and after the replicated aspect of said one special symbol of the particular type is displayed.

36. A gaming system as claimed in claim 19, wherein said symbol selector is configured to select a further set of normal symbols prior to each replication of an aspect of said one special symbol of the particular type.

37. A game controller comprising:

a symbol selector configured to select at least a first set of normal symbols to be displayed by the display and to display 1) said first set of normal symbols at a plurality of the display positions, and 2) to display one special symbol of a particular type of a plurality of special symbols at one of the display positions position;

a special symbol controller configured to replicate an aspect of said one special symbol of the particular type, the special symbol controller configured to maintain the displayed said one special symbol of the particular type at said one of the display positions, and to randomly select at least one display position of the plurality of display positions for display of the replicated aspect of said one special symbol of the particular type, and to display the replicated aspect of said one special symbol of the particular type at the randomly selected at least one display position if the randomly selected at least one display position does not already display a special symbol of the particular type of the plurality of special symbols, and if a particular display position corresponding to the at least one selected display position already displays a special symbol of the particular type, to display at the particular display position both (1) the special symbol of the particular type and (2) the replicated aspect of said one special symbol of the particular type; and an outcome generator configured to determine at least one game outcome based on the displayed one special symbol of the particular type, at least one of the displayed normal symbols, and the replicated aspect of the said one special symbol of the particular type, said outcome generator configured to provide an enhanced game outcome when both the special symbol of the particular type of said plurality of symbols and the replicated aspect of said one special symbol of the particular type are displayed at the particular display position.

* * * * *